United States Patent [19]

Dickens

[11] Patent Number: 4,631,037

[45] Date of Patent: Dec. 23, 1986

[54] PONTOON VEHICLE

[76] Inventor: James Dickens, 28 Westland St., Hartford, Conn. 06120

[21] Appl. No.: 739,519

[22] Filed: May 31, 1985

[51] Int. Cl.[4] ..... B63H 16/00

[52] U.S. Cl. ..... 440/100; 440/90

[58] Field of Search ..... 440/90, 98, 100, 21, 440/26, 30; 114/242

[56] References Cited

U.S. PATENT DOCUMENTS

| | | | |
|---|---|---|---|
| 2,287,706 | 6/1942 | Perry | 440/30 |
| 2,323,261 | 6/1943 | Vigo | 440/30 |
| 3,031,692 | 5/1962 | Riek | 440/30 |
| 3,045,636 | 7/1962 | Thomas | 440/26 |
| 3,091,209 | 5/1963 | Leiberman | 440/30 |
| 4,072,124 | 2/1978 | Meyrin | 440/31 |
| 4,077,351 | 3/1978 | Girona | 440/30 |
| 4,318,700 | 3/1982 | Price | 114/58 |
| 4,364,734 | 12/1982 | Haughton | 114/242 |
| 4,379,701 | 4/1983 | David | 440/26 |

*Primary Examiner*—Trygve M. Blix
*Assistant Examiner*—C. T. Bartz
*Attorney, Agent, or Firm*—Fishman & Dionne

[57] ABSTRACT

A self-propelled pontoon aquatic vehicle is presented which comprises a central pontoon having a seat, pedals and steering mechanism thereon. Paddle wheels are located on either side of the pontoon and include an inner tube with cleats fused thereon surrounding a foamed core. Preferably, the pontoon is comprised of a foamed plastic material.

6 Claims, 6 Drawing Figures

PONTOON VEHICLE

BACKGROUND OF THE INVENTION

This invention relates to a self-propelled pontoon aquatic vehicle. More particularly, this invention relates to a self-propelled aquatic vehicle comprising a central plastic foam pontoon having a seat, pedals and steering mechanism thereon. Paddle wheels are located on either side of the pontoon and include an inner tube with cleats thereon surrounding a foamed core.

Self-propelled aquatic vehicles which have a drive system similar to that of a bicycle are well known in the art. Examples of such aquatic vehicles are described in U.S. Pat. No. 2,323,261 to Vigo, U.S. Pat. No. 3,091,209 to Leiberman and U.S. Pat. No. 4,072,124 to Meyrin. Other examples of aquatic vehicles which utilize a human power drive system include U.S. Pat. Nos. 520,899 to Ronk, 2,287,706 to Perry, 2,998,798 to Love and 3,045,636 to Thomas et al. Unfortunately, most of the aquatic vehicles described in the above referenced U.S. Patents have not found wide practical acceptance due in part, to the relatively complicated and expensive constructions which are inherent in the disclosed designs.

Water sports and other pleasurable activities associated with lakes, rivers, oceans etc. now enjoy at least the same, if not greater, popularity throughout the world. Accordingly, there is a need for inexpensive aquatic vehicles having a relatively simple design which could be easily manufactured and thereby readily accessible to most persons.

SUMMARY OF THE INVENTION

The above discussed and other deficiencies and disadvantages of the prior art are overcome or alleviated by the aquatic vehicle of the present invention. In accordance with the present invention, a self-propelled aquatic vehicle comprising a central plastic foam pontoon having a seat, pedals and steering mechanism thereon is provided. An important feature of the present invention is the use of paddle wheels located on either side of the pontoon. The paddle wheels comprise an inner tube with cleats fused thereon surrounding a foam core.

The self-propelled aquatic vehicle of the present invention is of relatively simple design and can be manufactured with well known and existing parts. Accordingly, the present invention is both easy and inexpensive to manufacture so as to be readily accessible to all those who enjoy aquatic sports and other aquatic leisure activities.

The above discussed and other advantages of the present invention will be apparent to and understood by those skilled in the art from the following detailed description and drawings.

DESCRPTION OF THE DRAWINGS

Referring now to the drawings, wherein like elements are numbered alike in the several FIGURES.

DESCRIPTION OF THE PREFERRED EMBODIMENT

Figure 1:
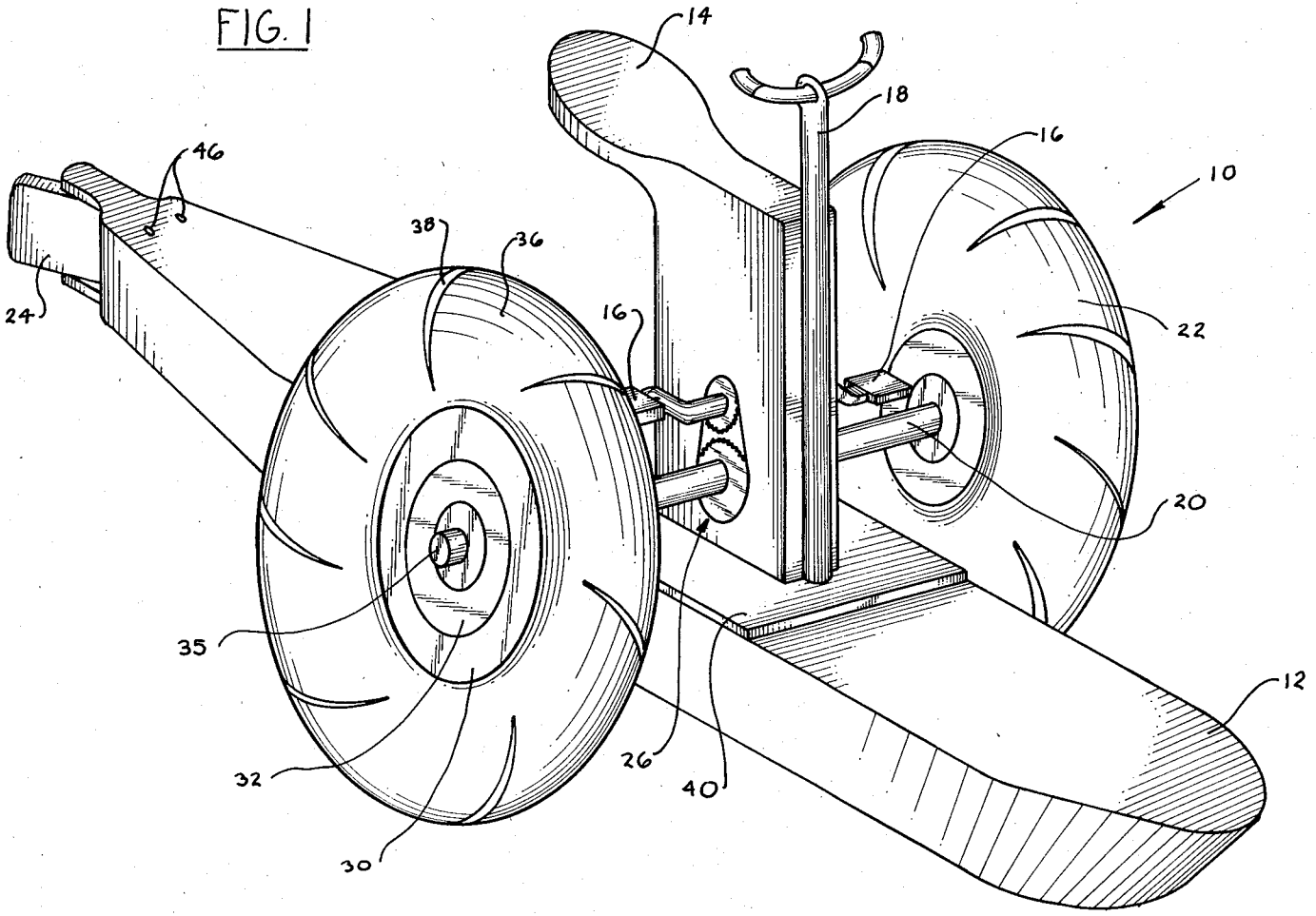
FIG. 1 is a perspective view of the self-propelled aquatic pontoon vehicle in accordance with the present invention.
Figure 3:
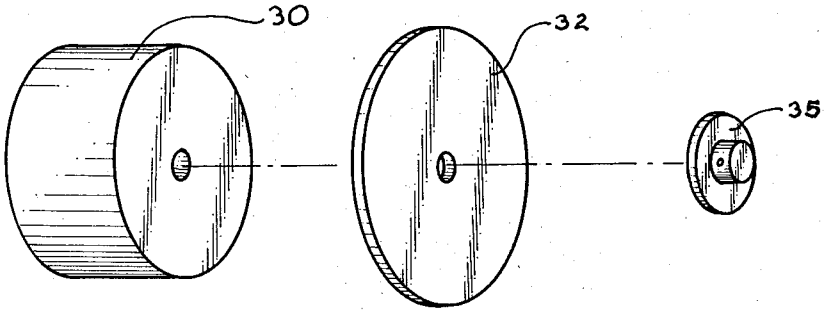
FIG. 3 is a perspective view of several of the structural elements from FIG. 2.
Figure 2:
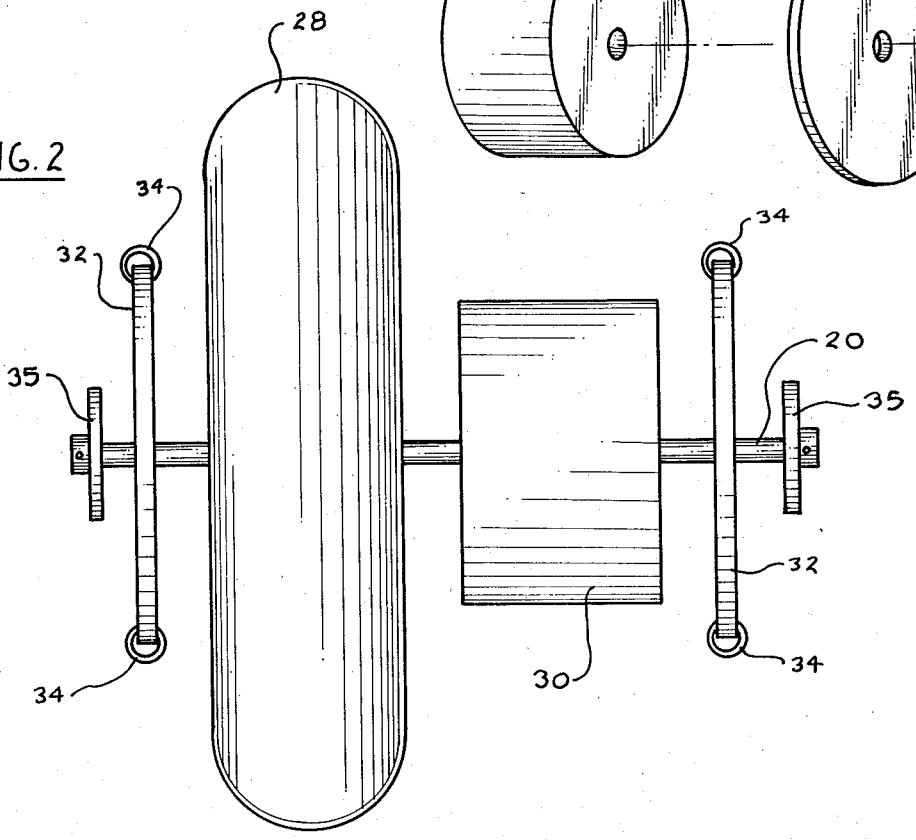
FIG. 2 is an exploded side elevation view of the paddle wheel construction used in conjunction with the aquatic vehicle of the present invention.

Referring first to FIG. 1, a self-propelled pontoon aquatic vehicle in accordance with the present invention is shown generally at 10. Aquatic vehicle 10 is comprised of a central pontoon 12 which forms the base of the vehicle. Pontoon 12 includes a seat 14, pedals 16, and a steering mechanism 18 thereon. Pedals 16 are connected via any suitable and well known drive system, i.e., a chain drive system for example, to an axle 20. A pair of paddle wheels 22 are then provided onto each end of axle 20. Steering wheel 18 is connected via any suitable and well known method to rudder 24 which is located at the rear end of pontoon 12. As is clearly shown in FIG. 1, Pontoon 12 has an elongated non-circular configuration and extends forwardly and rearwardly of paddle wheels 22.

Figure 5:
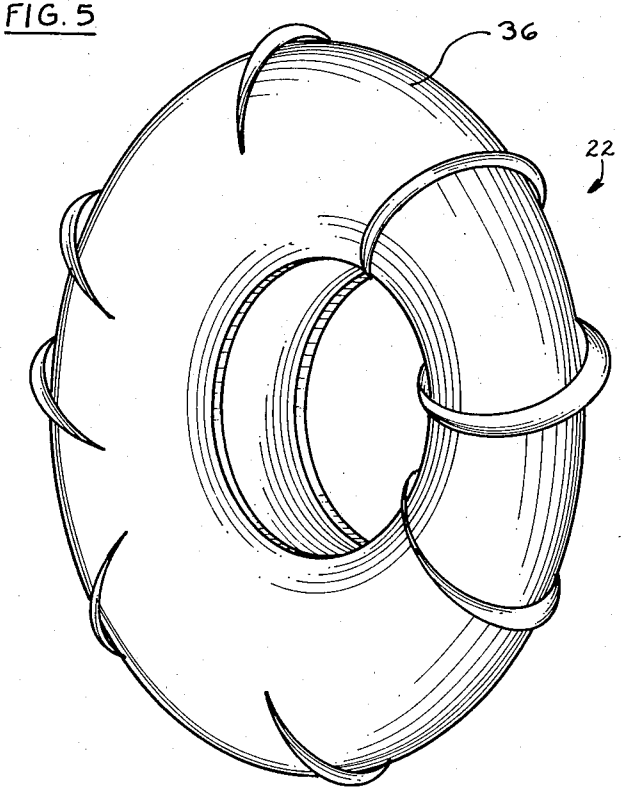
FIG. 5 is a perspective view of a split tube having cleats thereon which is slipped onto the inner tube of FIG. 4.
Figure 4:
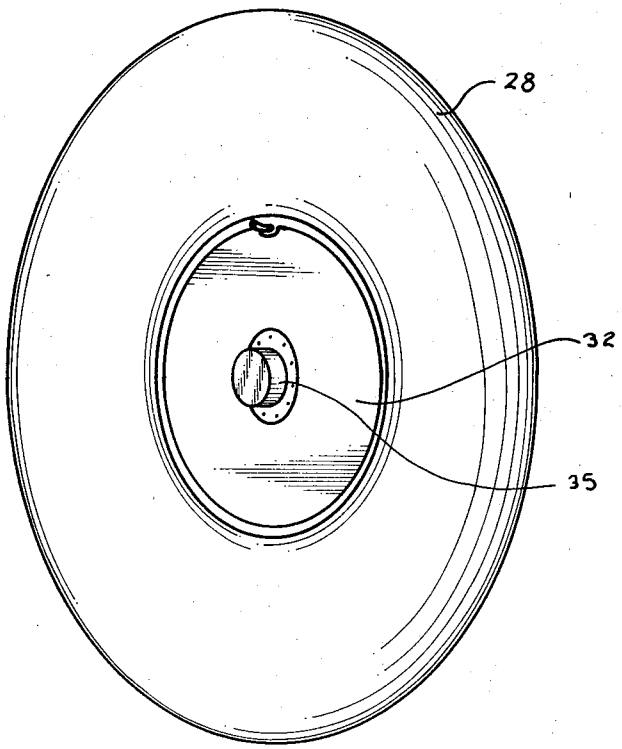
FIG. 4 is a perspective view of an inner tube used in conjunction with the paddle wheels of the present invention.

Turning to a joint discussion of FIGS. 2–5, an important feature of the present invention is the novel construction of each paddle wheel 22. Paddle wheels 22 are comprised of a rubber inner tube such as used in a motor vehicle tire shown at 28 in FIG. 2 and FIG. 4; having a Styrofoam or other foamed polymeric core 30 centrally located thereon. Preferably, a marine plywood or other suitable protective material is provided to each side of foamed core 30 in the form of a rim plate 32. In a preferred embodiment, a split rubber hose 34 or similar structure is disposed about the perimeter of rim plate 32 to provide protection against chaffing and eventual puncture of rubber inner tube 28. Rubber inner tube 28, foamed core 30 and rim plate 32 are all mounted on axle 20 and are held tightly thereon by a metal or plastic hub 35. After the hubs 35, rim plates 32 and Styrofoam core 30 have been assembled on the inner tube 28, the tube is inflated to approximately two thirds of maximum inflation. At that point, a split tube with cleats shown at 36 in FIGS. 1 and 5 is pulled over inner tube 28.

As mentioned, this unique construction of paddle wheels 22 provides a buoyant and inexpensive means for driving aquatic vehicle 10. The several parts which comprise paddle wheel 22 are all readily accessible, inexpensive to manufacture and obtain and require little alteration in assembling the paddle wheels 22. For example, inner tubes 28 may simply consist of tire truck inner tubes while split tube 36 having cleats 38 thereon may also simply consist of a split truck tire inner tube which is easily adapted to perform the indicated function by the addition of vulcanized cleats thereon. It will be appreciated that the paddle wheel construction of the present invention not only serves to drive the aquatic vehicle, but also serves to provide buoyancy to the aquatic vehicle as well. Accordingly, the paddle wheels 22 also provide floatation along with central pontoon 12.

The self-propelled pontoon aquatic vehicle of the present invention is operated in the following manner.

Initially, the vehicle is positioned in a body of water such as a lake, river, etc. whereupon a person boards the vehicle and positions himself or herself onto seat 14. Pedals 16 are then actuated in a method similar to that of a bicycle whereupon axle 20 is driven by the appropriate gear or chain system identified at 26 in FIG. 1. At that point, paddle wheels 22 will rotate. As wheels 22 rotate, the cleats 38 thereon will contact the water and thereby drive vehicle 10 in a well known manner. Aquatic vehicle 10 is directed by use of steering wheel 18 which controls and operates rudder 24.

In a preferred embodiment, pontoon 12 is comprised of a foamed polymeric material to provide low cost and easy manufacture. Alternatively, pontoon 12 may be comprised of any other suitable materials such as a hollow wood construction. Also, steering wheel 18, seat 14 and the drive mechanism of the present invention are preferably positioned on a support structure 40 which may simply consist of rectangular plywood board.

Figure 6:
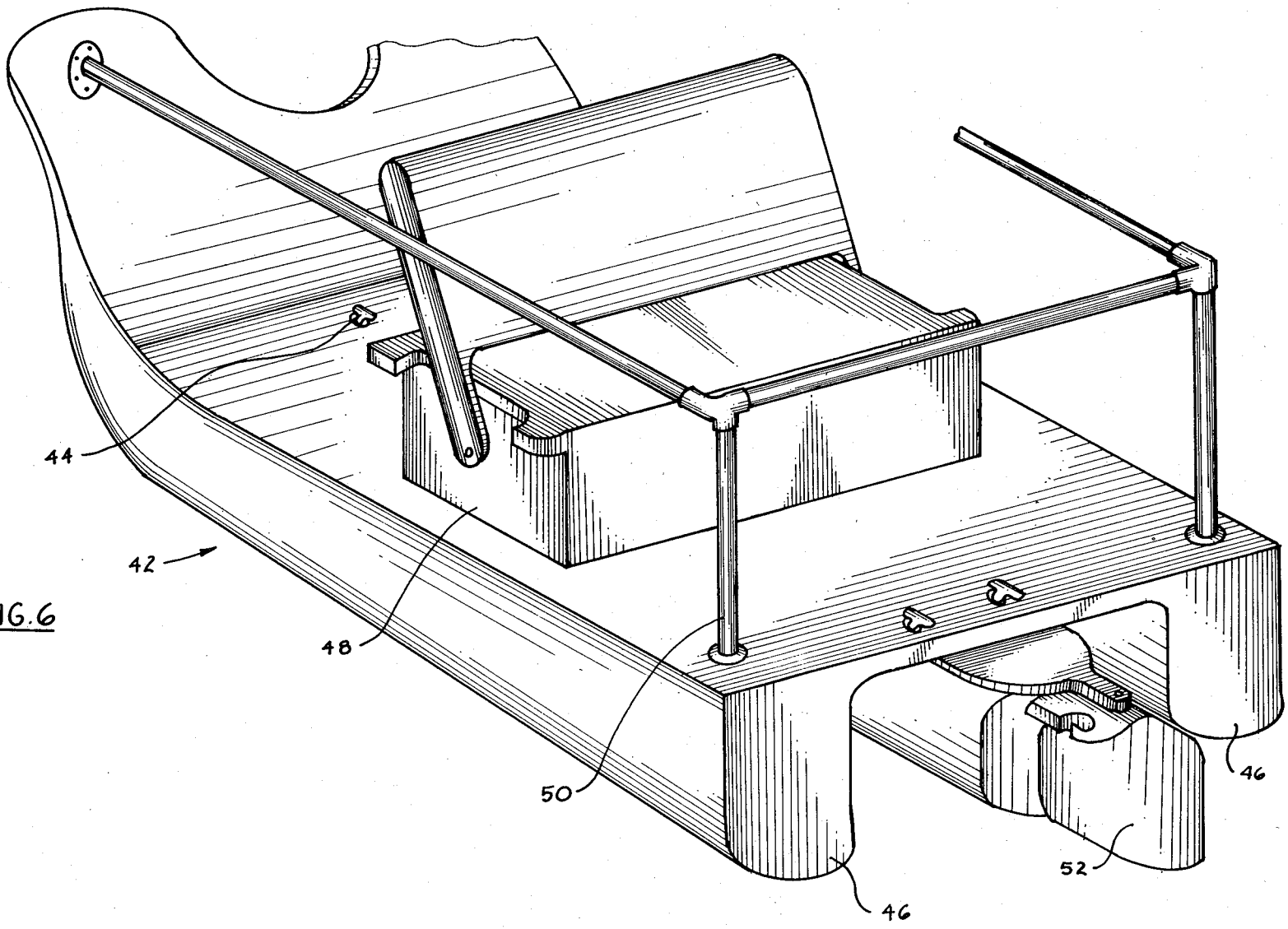
FIG. 6 is a perspective view of a passenger extension vehicle which may be used in conjunction with the aquatic vehicle of FIG. 1.

While the aquatic vehicle shown in FIG. 1 is well suited for a single operator, in a preferred embodiment, aquatic vehicle 10 is adapted to be used in conjunction with a detachable passenger float such as the passenger float shown at 42 in FIG. 6. Such a float 42 may be easily attached or detached to vehicle 10 via bolts 44 which may connect to bolt holes 46 on vehicle 10. Passenger float 42 may be comprised of a floating pontoon structure 46 having at least one seat 48 thereon along with a protective railing 50. A rudder 52 which is similar to rudder 26 in aquatic vehicle 10 is also preferably provided to passenger float 42. Rudder 52 is adapted to connect with the steering system comprising steering wheel 18 and rudder 26 of vehicle 10 so that the operator of vehicle 10 may direct rudder 52 of passenger float 42 via steering wheel 18.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An aquatic vehicle comprising:

central pontoon means adapted to float on water and including an upper surface thereon, said pontoon means being an elongated, non-circular member extending forwardly and rearwardly of a pair of paddle wheel means;

seat means attached to said upper surface of said pontoon means;

steering means adjacent said seat means and attached to said pontoon means;

a rudder pivotably attached to said pontoon means at one end thereof and being connected to said steering means;

said pair of paddle wheel means being disposed at opposed locations on either side of said pontoon means and being interconnected by an axle wherein said paddle wheel means are adapted to provide buoyancy and propulsion, said paddle wheel means comprising;

a plastic buoyant core;

a fluid tight elastomeric inner tube surrounding said core and having fluid therein;

an outer tube surrounding said inner tube, said outer tube having cleats thereon; and drive means for dirving said pair of paddle wheel means.

2. The aquatic vechicle of claim 1 wherein:

said pontoon means is compressed of a foamed plastic material.

3. The aquatic vehicle of claim 1 wherein:

said core is comprised of a foamed plastic material.

4. The aquatic vehicle of claim 1 including:

rim plates disposed on opposed sides of said core.

5. The aquatic vehicle of claim 4 including:

split hose means disposed about the perimeter of said rim plates.

6. The aquatic vehicle of claim 1 including:

passenger float means detachably and rigidly connected to said central pontoon menas and steering means.

* * * * *